US005860258A

United States Patent [19]

Faith et al.

[11] Patent Number: 5,860,258

[45] Date of Patent: Jan. 19, 1999

[54] MODULAR BUILDING

[76] Inventors: William C. Faith; Sally L. Labrato-Faith, both of 18582 Brookhurst, Fountain Valley, Calif. 92708

[21] Appl. No.: 871,073

[22] Filed: Jun. 9, 1997

[51] Int. Cl.[6] ..... E04H 1/00

[52] U.S. Cl. ..... 52/236.2; 52/79.4; 52/82; 52/245

[58] Field of Search ..... 52/82, 236.2, 245, 52/247, 79.4

[56] References Cited

U.S. PATENT DOCUMENTS

| | | | |
|---|---|---|---|
| 2,944,370 | 7/1960 | Malarkey . | |
| 2,982,290 | 5/1961 | Hunziker . | |
| 3,092,216 | 6/1963 | Tye | 52/247 |
| 3,295,265 | 1/1964 | Hida . | |
| 3,543,454 | 12/1970 | Danin | 52/79.4 |
| 3,763,608 | 10/1973 | Chamlee . | |
| 3,999,337 | 12/1976 | Tomassetti, Jr. . | |
| 4,400,927 | 8/1983 | Wolde-Tinase . | |
| 4,612,741 | 9/1986 | Jacobson | 52/79.4 |
| 4,677,796 | 7/1987 | Mellott . | |
| 4,788,803 | 12/1988 | Seitz | 52/82 |
| 5,050,354 | 9/1991 | Vendramini | 52/80 |
| 5,341,610 | 8/1994 | Moss . | |

*Primary Examiner*—Carl D. Friedman
*Assistant Examiner*—C. Min Choe
*Attorney, Agent, or Firm*—Dennis W. Beech

[57] ABSTRACT

The modular building is a basically circular building structure formed by assembling pie or wedge shaped modular elements. The modular elements are radially attached around a center column anchored in a column footing. The attachment of the modular elements is by use of collars on the center column which allow rotation about the floor collar and slotted motion about the roof collar. The modular elements are not rigidly attached one to the other. This allows for limited independent movement relative to each other such as during earth movement. The floor sections of the modular elements are mounted on foundation elements assembled radially around the center column. Use of modular elements allows factory manufacture and assembly efficiency and then construction of the modular building at the building site.

3 Claims, 3 Drawing Sheets

MODULAR BUILDING

BACKGROUND OF THE INVENTION

1. Field of the Invention

This invention relates to modular construction for buildings. The new structure for buildings allows manufacture of pie or wedge shaped modules in a factory and then movement to the construction site for assembly.

2. Description of Related Art

There are various known techniques for construction of circular or dome shaped structures. These are usually constructed of modular wall and roof elements which are pieced together to form the structure. One such example of this is disclosed in U.S. Pat. No. 4,788,803. A more famous version of such construction is the geodesic dome which doesn't require a central column or pole.

A different version of the circular shaped structure is one in which more integrated modular elements are constructed and then assembled into a structure. An example of such a building is disclosed in U.S. Pat. No. 4,612,741. In such structures the wedge shaped modular elements are designed to tightly fit together to form sealed integrated units to which walls, etc. are then added to form the rooms.

The present invention uses pie or wedge shape modules which include the internal wall elements. This provides a completed modular unit which when assembled with multiple modular units forms a complete structure with little structural finishing work required. The pie shape modules are flexibly attached to a central column and are not rigidly attached to each other. This provides for flexibility in movement as for example during an earthquake. The modules have insulation material between adjoining modular structural elements for environmental control.

SUMMARY OF THE INVENTION

One object of the present invention is the definition of a modular structural element which when assembled with compatible elements forms a modular building. Another object is to allow modular element construction which includes internal walls to be constructed in each module prior to building assembly. A further object is to assemble the structure in a form to allow flexibility and strength to be tolerant of environmental anomalies such as earthquakes. Another object is to allow insulation and environmental protection at modular element joints which insulate the building interior yet allow relative motion between modular elements.

In accordance with the description presented herein, other objectives of this invention will become apparent when the description and drawings are reviewed.

DESCRIPTION OF THE PREFERRED EMBODIMENT

Figure 2:
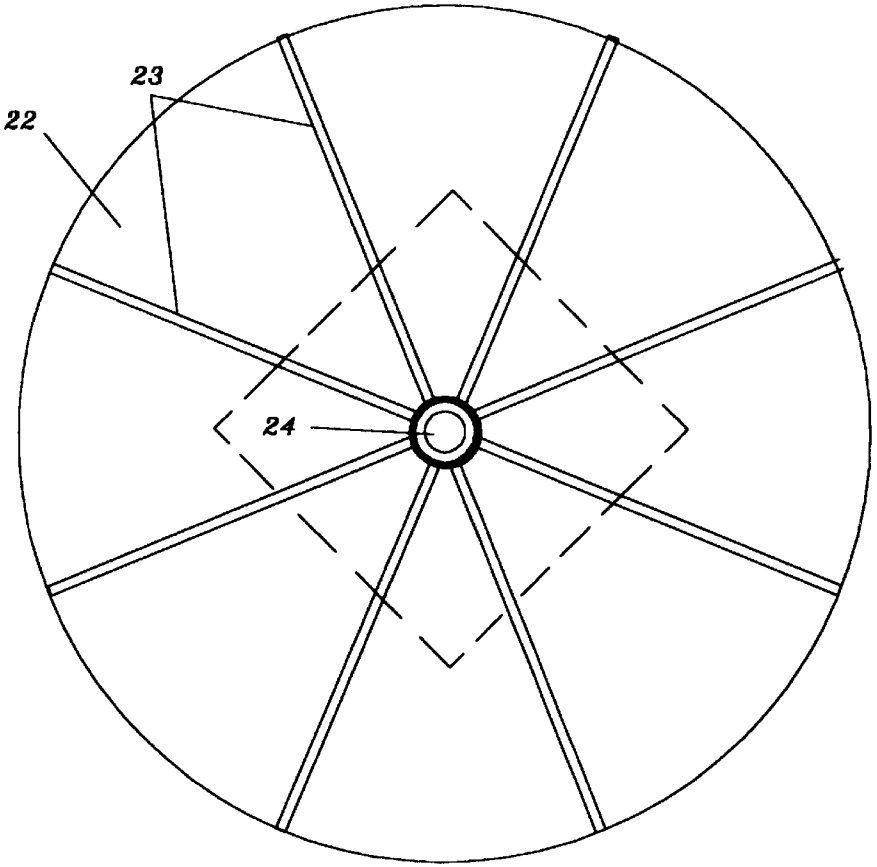
FIG. 2 illustrates a top view of the modular building.

The modular building is formed of multiple wedge shaped modular elements radially disposed around and attached to a central column. The central column is firmly anchored in a concrete footing. The floor of each modular element rests on a foundation wall or on structural columns depending on the desired use of the space under the modular elements.

Referring to FIGS. 1 through 4, a plurality of wedge or pie shaped modular elements (1) are radially attached around a center column (2) to form a modular building (3). The modular elements (1) are normally constructed at a factory or other off site location which allows economy of manufacture and assembly. This includes location of internal wall elements, plumbing, built ins, and the like. In addition each modular unit (1) has a roof section (4), wall section (5) and floor section (6). The wall section (5) may have a door (7), window (8) or other feature.

Referring to FIGS. 1 through 6A, the roof section (4) at the column end (9) has a slot (10) for an attachment bolt (11). A roof collar (12) is attached adjacent to the top (13) of the center column (2) and has attachment arms (14). The attachment arm (14) fits in attachment slot (15) and attachment bolt (11) is inserted through slot (10) and arm aperture (16) to retain the modular element (1) to the center column (2) yet allow for some movement by means of slot (10).

Similarly the floor section (6) at the column end (9) has a floor aperture (17) for an attachment bolt (11). A floor collar (18) is attached to the center column (2) intermediate the top (13) and the column footing (19). Attachment arm (14) on the floor collar (18) fits in attachment slot (15) and attachment bolt (11) is inserted through floor aperture (17) and arm aperture (16) to retain the modular element (1) to the center column (2) yet allow for some rotation.

Figure 3:
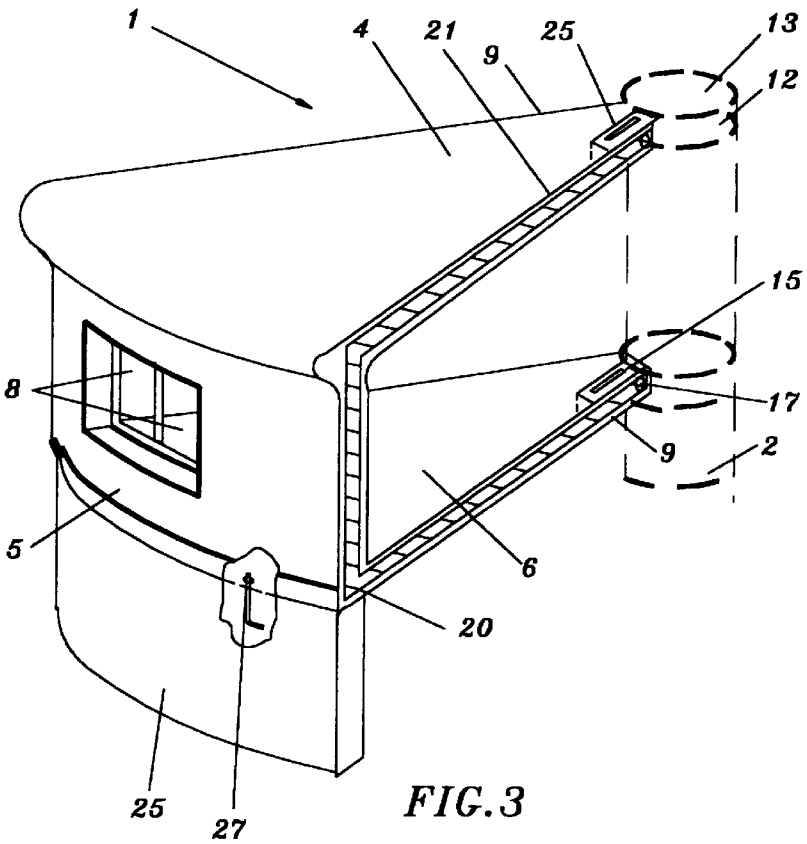
FIG. 3 illustrates a perspective view of a modular element and center column.

Referring to FIGS. 2 and 3, the modular element (1) has joint insulation material (20) attached at the joint interface (21). This is normally flexible material such as synthetic rubber and the like such that adjoining modular elements (1) are sealed at the joint interface (21), but are free to move relative to each other.

Figure 1:
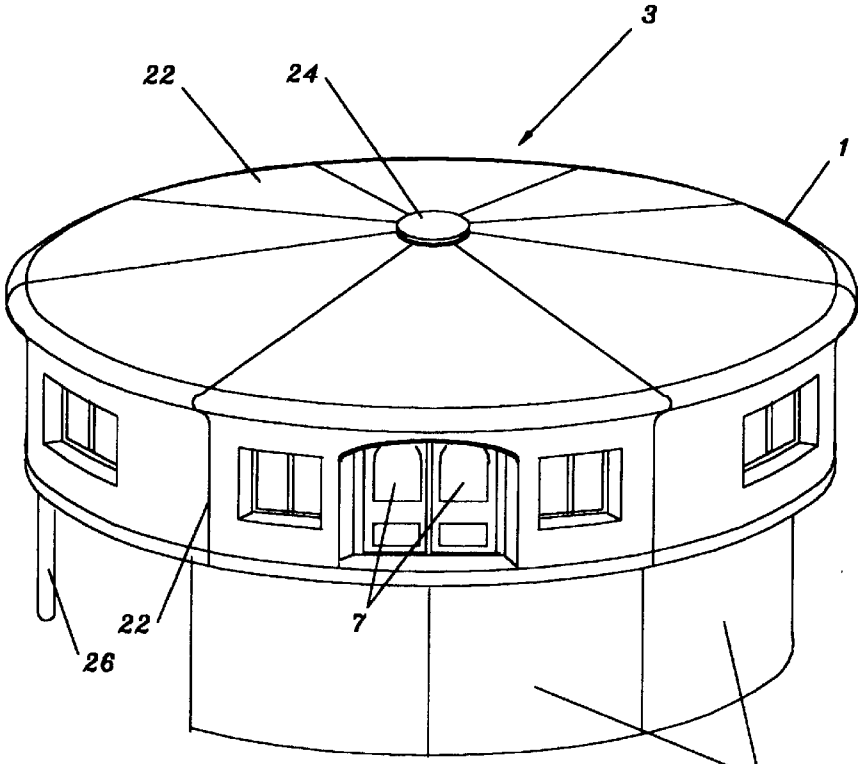
FIG. 1 illustrates a perspective view of the modular building.
Figure 4:
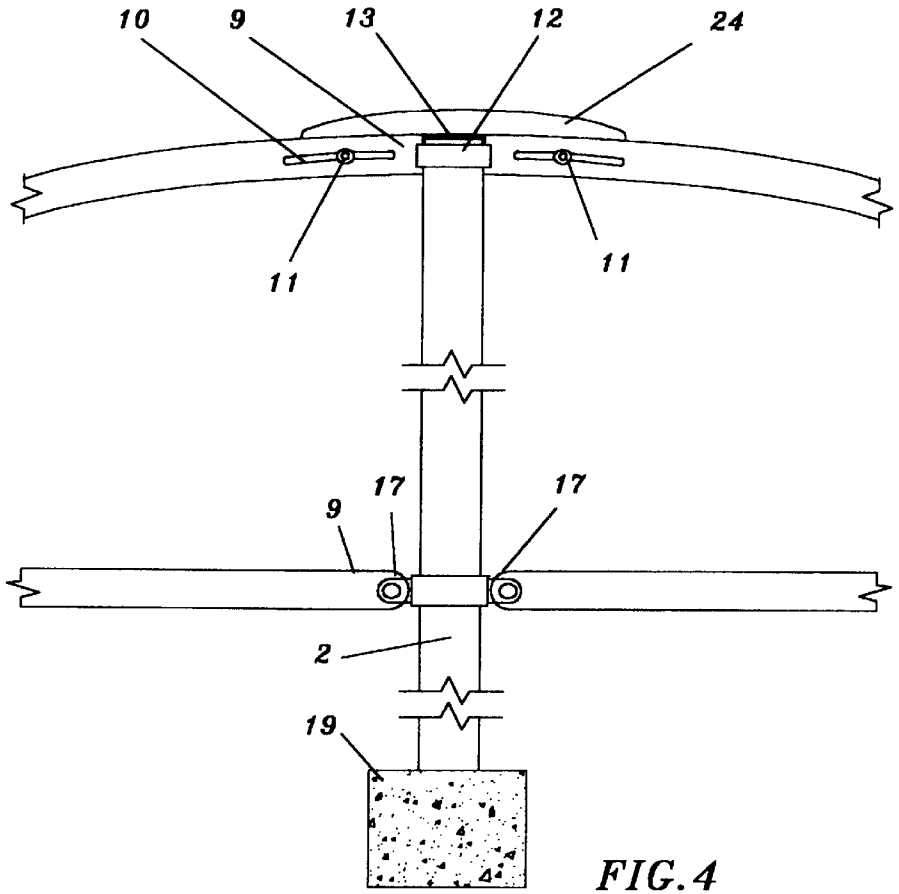
FIG. 4 illustrates an elevation view of the center column with modular elements attached.

Referring to FIGS. 1, 2 and 4, the roof (22) is further sealed for environmental purposes by use of roof strips (23) at joint interface (21) and by roof cap (24).

Figure 7:
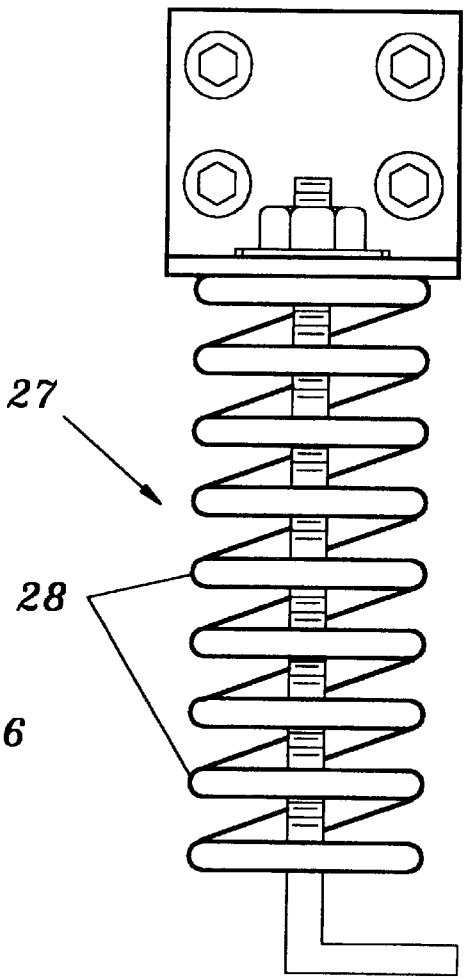
FIG. 7 illustrates a side view of the flexible connecting bolt.
Figure 6:
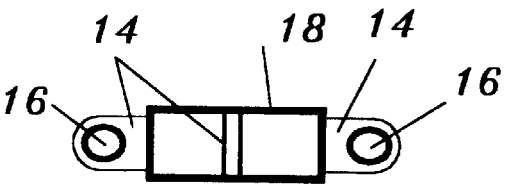
FIG. 6 illustrates a side view of the floor collar.
Figure 6A:
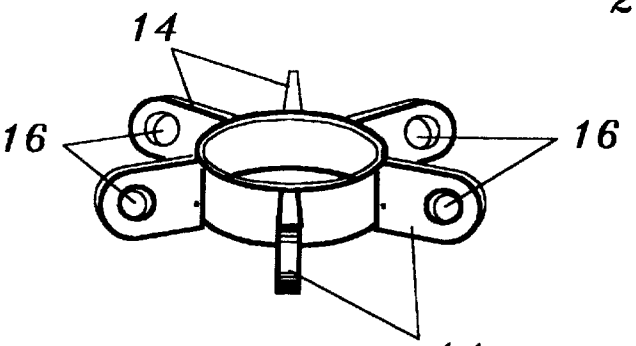
FIG. 6A illustrates a perspective view of the floor collar.
Figure 5:
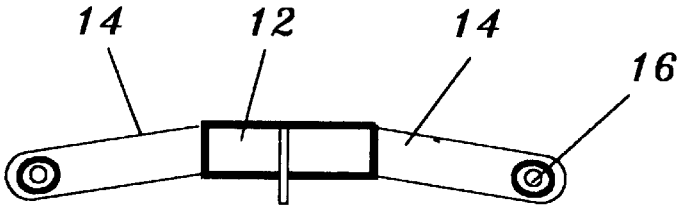
FIG. 5 illustrates a side view of the roof collar.
Figure 5A:
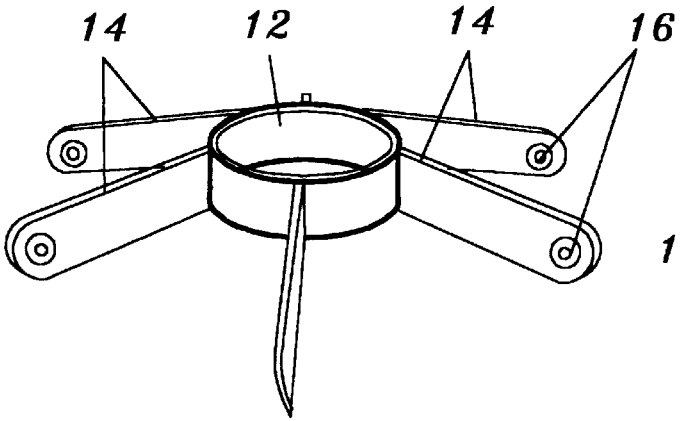
FIG. 5A illustrates a perspective view of the roof collar.

Referring to FIGS. 1, 3 and 7, the floor section (6) may be mounted on a foundation wall (25) or a foundation column (26). These foundation elements may be of variable height and configuration depending on the desired use of the space under the modular elements (1). The floor section (6) may be attached to the foundation elements by flexible connecting bolts (27) which have a tension spring (28) to allow some movement at the attachment point such as during underlying earth movement.

I claim:

1. A basically circular modular building comprising:

a plurality of modular elements constructed in a wedge shape having a roof section, a wall section and a floor section;

each modular element at a joint interface having a joint interface material attached;

a center column attached to a column footing wherein the center column having a roof collar attached at a top and a floor collar attached intermediate the top and the column footing with the roof collar and the floor collar each having a plurality of attachment arms with an arm aperture defined therein;

the roof section at a column end having an attachment slot to receive the attachment arm and having a slot defined therein for receiving an attachment bolt for engagement of the arm aperture;

the floor section at a column end having an attachment slot to receive the attachment arm and having a floor aperture defined therein for receiving an attachment bolt for engagement of the arm aperture; and a foundation element radially disposed around the center column such that the floor section may rest thereon.

2. The modular building as in claim 1 wherein a roof having a plurality of roof strips placed over the joint interface and a roof cap.

3. The modular building as in claim 1 wherein the floor section is attached to the foundation elements by a plurality of flexible connecting bolts.

* * * * *